United States Patent [19]

Silber

[11] Patent Number: 4,491,366

[45] Date of Patent: Jan. 1, 1985

[54] MULTI-POSITIONAL CHAIR

[76] Inventor: Victor Silber, 4254 D'Este Ct., Apt. 202, Lake Worth, Fla. 33460

[21] Appl. No.: 308,810

[22] Filed: Oct. 5, 1981

[51] Int. Cl.[3] ..... A47C 3/026

[52] U.S. Cl. ..... 297/329; 297/322; 297/327

[58] Field of Search ..... 297/329, 322, 300, 318, 297/326, 327, 328

[56] References Cited

U.S. PATENT DOCUMENTS

| | | | |
|---|---|---|---|
| 1,155,893 | 10/1915 | Crippen | 297/326 X |
| 1,836,353 | 12/1931 | Withrow | 297/326 X |
| 2,611,420 | 9/1952 | Diehl | 297/318 X |
| 2,660,222 | 11/1953 | Woodsworth | 297/318 X |

FOREIGN PATENT DOCUMENTS

| | | | |
|---|---|---|---|
| 23927 | of 1913 | United Kingdom | 297/329 |
| 509033 | 10/1937 | United Kingdom | 297/329 |
| 2061100 | 5/1981 | United Kingdom | 297/329 |
| 548460 | 3/1977 | U.S.S.R. | 297/318 |

*Primary Examiner*—Francis K. Zugel
*Assistant Examiner*—Peter R. Brown
*Attorney, Agent, or Firm*—Posnack, Roberts, Cohen & Spiecens

[57] ABSTRACT

A new and improved chair is presented. In one embodiment the chair has a base, each side of the base having a front guide member and a rear guide member operably connected thereto. Each side of the seat portion of the chair has one end of a front roller pivot member and one end of a rear roller pivot member connected thereto. The opposite end of the front roller pivot member has a roller rotatably mounted thereto and the opposite end of the rear roller pivot member has a rear roller rotatably mounted thereto. The front and rear rollers ride in the front and rear guide members in order to change positions of the seat portion. The front guide member slopes downwardly from its rear end to its front end, while the rear guide member slopes downwardly from its front end to its rear end in order to enable the user to use his body weight to shift the seat position from at least a first position to a second position and vice versa. In another embodiment the rollers are operably connected to the base and the roller guides are connected to the seat portion.

2 Claims, 4 Drawing Figures

MULTI-POSITIONAL CHAIR

BACKGROUND OF THE INVENTION

The present invention relates to chairs and more particularly to a multi-positional chair, having at least one position which maintains the occupant in a correct posture sitting position for a relaxed position and also maintains the accurate and correct posture sitting position in a working position at a desk or table. The proper posture is maintained in all intermediate positions between the fully relaxed position and work position.

In the past, various types of multi-positional chairs have been presented. By way of example U.S. Pat. No. 2,925,122 which illustrates a reclining chair. The chair includes a substantially vertically oriented bracket with curved slots connected to the back portion of the chair which slidably engages with pins connected to the seat portion of the chair in order to allow multiple positioning based on the weight distribution of the occupant of the seat.

The present invention provides a new and improved system for varying the positions of the seat portion of the reclining chair making the shifts from one position to another more effortless than in the devices of the prior art.

SUMMARY OF THE INVENTION

According to the present invention a new and improved multi-positional chair is presented.

In the most simplistic embodiment of the invention a pair of roller guide members are connected to each side of a base. The front guide member slopes downwardly from its rear end to its front end and the rear guide member slopes downwardly from its front end. These members to its rear end and have lips for receiving and retaining rollers. The seat portion of the device has on each side at least a pair of roller bracket members in spaced relation with rollers rotatably connected thereto, the rollers being sized to fit the front and rear guide members lips. By having the front and rear guide members sloping in opposite directions, the force exerted by shifting the weight of the occupant causes rotational movement of the seat portion in the direction of weight distribution in order to positively change positions of the seat portion in the guide members.

In another embodiment the front and rear guide members are connected to an intermediate frame member which has its rear end pivotally connected to the base and front end connected to an adjustable restraining member to limit the angle of incline for the relaxed position, to limit the angle of incline when in the working position and also to dampen the movement of the frame as the seat portion is moved from a relaxed position to a working position.

In another embodiment a single guide member connected to each side of the seat portion is utilized to engage the respective roller members and rollers connected to the base. Each front roller member is slidingly connected to the base to allow axial movement of the roller member inwardly and outwardly relative to the base. Each front roller member is biased outwardly from the base by a resilient member such as a spring which also dampens movement of the seat portion as it is moved into a working position.

It is therefore an object of this invention to provide a new and improved multi-positional chair which maintains the occupant in the correct sitting position in all positions.

It is another object of this invention to provide a new and improved multi-positional chair which better utilizes the weight of the occupant to change the positions of the chair.

It is yet another object of this invention to provide a new and improved multi-positional chair with a roller pivot and guide system which creates a rotating movement around the pivots as caused by the weight shift of the occupant to move the roller pivot and rollers in the guides to change positions of the seat.

In accordance with these and other objects which will be aparent hereinafter, the instant invention will now be described with particular reference to the accompanying drawings.

DESCRIPTION OF THE PREFERRED EMBODIMENT

Figure 1:
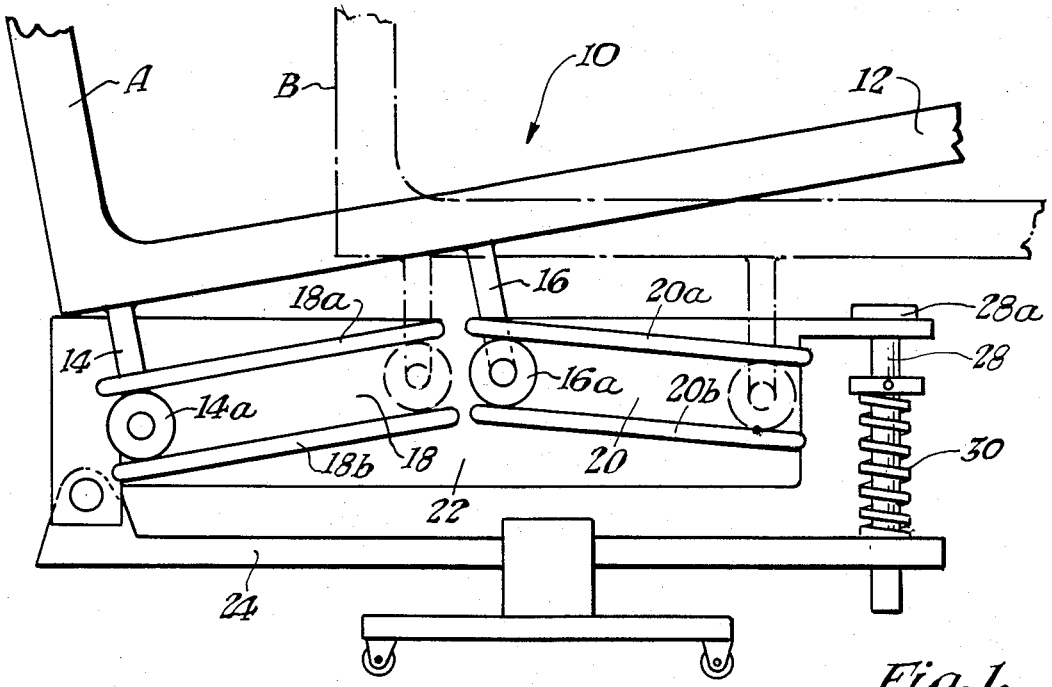
FIG. 1 is side elevational view of the present invention, the opposite side being a mirror image thereof.

Referring now to FIG. 1, the new and improved multi-positional chair is shown generally at 10. The chair 10 includes the seat portions 12 having the roller pivot members 14 and 16 each having the respective rollers 14*a* and 16*a* pivotally connected thereto. The rollers 14*a* and 16*a* are sized to ride in the guide members 18 and 20 which are connected to the frame member 22 by screws, bolts or other connecting means well known in the art. The frame member 22 is connected to the base member 24 by way of the pin 26 so that the frame member 22 may rotate about the pin 26 relative to the base 24. The front of the frame member 22 is engaged with the adjustable bolt 28 connected to the base member 24. The top portion 28*a* of the bolt limit the reclining angle of the seat portion and frame member 22, and the spring or other resilient member 30 can also be included to dampen the frame member as the seat is moved forward into the working position. It should be noted that the frame member 22 may be integral with the base 24 without having the pivot pin 26 and the bolt 28 so that the total base, comprised of the frame member 22 and the base member 24, remains stationary.

In the fully relaxed position (Position A) the seat portion 12 is tilted with the front end at an upward angle. The user enters the seat in this position and puts his total weight in the seat portion. If the user wishes to move to a working position (Position B), he shifts his weight so that his thighs press on the front of the seat. A combination of vertical and horizontal force is created which causes a forward movement of the seat with respect to the base and rotational movement about the roller pivots 14 which are attached to the bottom of the seat. The rotation causes the rear of the seat to move upward as the front moves downward. The upward movement of the seat is controlled by the rollers 14*a* and 16*a* moving in the guide members 18 and 20, the rollers being retained in the guide members by the lips 18*a*, 18*b*, 20*a*, and 20*b*. The motion of the front of the seat is controlled by the rollers 14*a* and 16*a* riding in the guide members 18 and 20. It should be noted that the guide members 18 and 20 may be adjustable both vertically and angularly. The user sets the initial position of the chair so that when in position B, the working position, his mid-section is at a proper position with the respect to the working surface of a desk which he will be working at. The user then enters the chair in position A and moves the seat to where he wishes to be. Throughout this movement the users back is supported in the correct posture position. The seat portion 12 at position B is substantially horizontal. The final angle of the seat portion 12 at working position B and a degree of reclining can be present by adjustment of the front and rear guides. Once the location of the chair is established it can be fixed in that spot. The user can enter or leave by swiveling the chair in position, if a swivel base (not shown) is desired.

Figure 2:
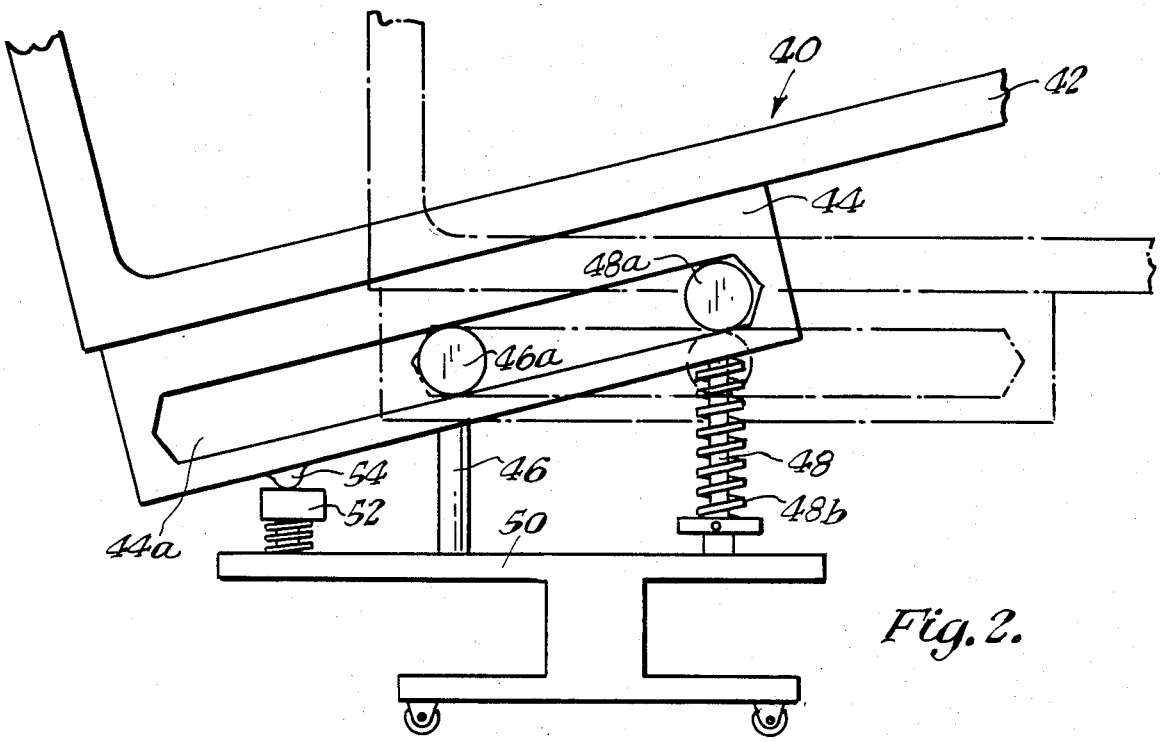
FIG. 2 is a side elevational view of another embodiment of the present invention, the opposite side being a mirror image thereof.

Referring now to FIG. 2 another embodiment of the present invention is shown generally at 40. The chair 40 comprises a seat portion 42 having the guide bracket 44 connected to the bottom thereof by bolts, screws, or any other connecting means well known in the art. In this embodiment the roller pivot members 46 and 48 are connected to the base 50 such that the rollers 46*a* and 48*a* ride in the longitudinal slot 44*a* of the guide member 44. The roller pivot member 48 is slidingly connected with the base 50 and is associated with the resilient springs 48*b* to allow axial movement of the roller pivot member 48 upwardly or downwardly as the seat portion 42 is moved from a reclining position to a sitting working position or vice versa. The rear of the base 50 includes a resilient bumper member 52 which limits the angle of the reclining position and dampens the downward movement of the seat as it goes into the reclining position. The protuberance 54 is connected to the guide member 44 in a position to contact the resilient bumper as necessary.

Figure 3:
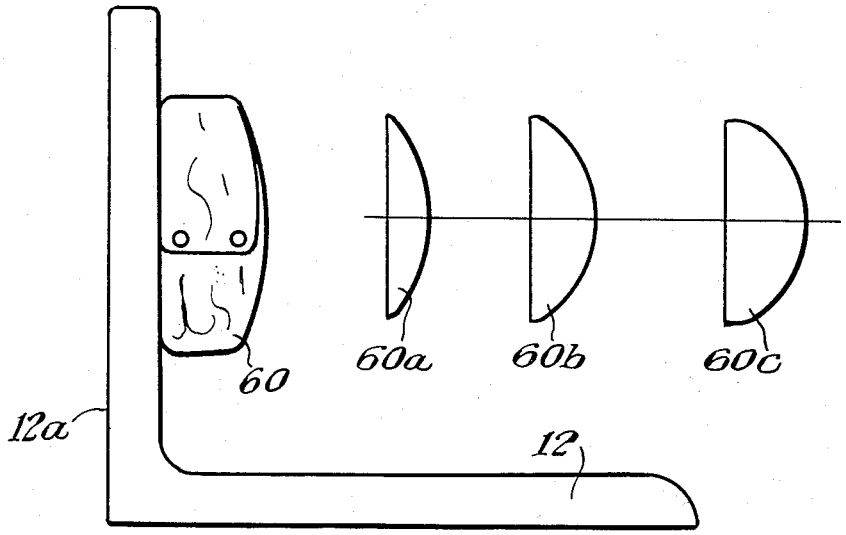
FIG. 3 is a side elevational view of the seat portion of the present invention.
Figure 4:
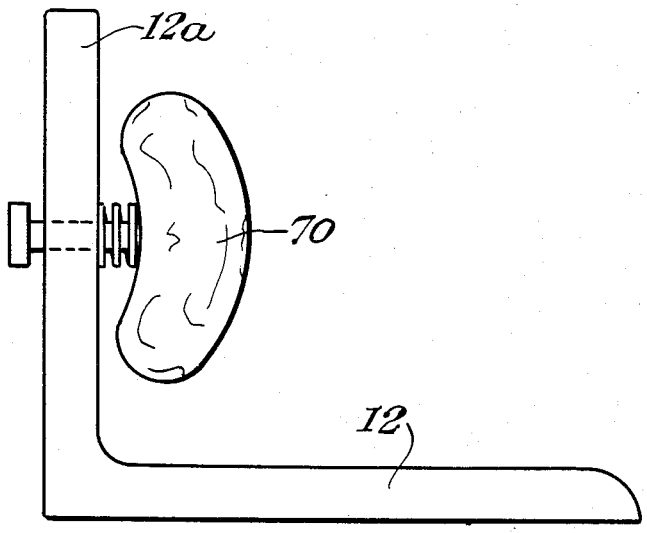
FIG. 4 is a side elevational view of another embodiment of the seat portion of the present invention.

Referring now to FIGS. 3 and 4 the seat portion 12 may have the cushions 60 or 70 connected to the back 12*a* thereof. The cushions 60 or 70 are positioned along the back portion 12*a* of the seat portion 12 in order to fit into the small of the back of the user. Provisions are made for different curvatures of the spine by changing the shape of the cushion as shown in 60*a*, 60*b* and 60*c* of FIG. 3. In FIG. 3, the cushion may be connected to back portion 12*a* by screws or glue or other relatively secure connectors. FIG. 4 illustrates that the cushion can be connected by way of an adjustable threaded bolt and screw handle arrangement to vary the inward projection distance of the cushion into the back of the user.

The instant invention has been shown and described herein in what is considered to be the most practical and preferred embodiment. It is recognized, however, that invention and that obvious modifications will occur to a person skilled in the art.

What I claim is:

1. A new and improved multi-positional chair, comprising:

a seat portion, each side of said seat portion having a slotted guide member connected thereto;

a base member, each side of said base member having a rear roller pivot member and a front roller pivot member slidably engaged in the base member;

said rear roller'pivot member and said front roller pivot member having a roller pivotally mounted thereon;

each said roller being operably engaged in said slotted guide member;

each front roller pivot having resilient means for biasing said roller pivot upwardly, forcing said seat portion into a reclining position;

said resilient portion dampening inward axial movement of said front roller pivot when forward and downward force is exerted on said seat portion.

2. A new and improved multi-positional reclining chair, as set forth in claim 1, wherein:

said base member having a rear bumper member for limiting the reclining position of said seat portion.

* * * * *